US005682627A

United States Patent [19]

Russell

[11] Patent Number: 5,682,627

[45] Date of Patent: Nov. 4, 1997

[54] GLASS PROTECTING SHOWER CURTAIN SYSTEM

[76] Inventor: Cheryl E. Russell, 20425 119th Ave. SE., Kent, Wash. 98031

[21] Appl. No.: 767,303

[22] Filed: Dec. 16, 1996

Related U.S. Application Data

[63] Continuation-in-part of Ser. No. 653,155, May 24, 1996, abandoned.

[51] Int. Cl.[6] ..... A47K 3/14

[52] U.S. Cl. ..... 4/558; 4/608; 160/23.1

[58] Field of Search ..... 4/557, 558, 605, 4/607, 608, 610; 160/23.1, 24, 323.1, 324; 248/252, 254, 266, 267

[56] References Cited

U.S. PATENT DOCUMENTS

| | | | |
|---|---|---|---|
| 3,222,689 | 12/1965 | Efron et al. | 4/558 |
| 3,595,511 | 7/1971 | Summerville, Jr. | 160/324 |
| 3,965,960 | 6/1976 | Massey | 160/291 |
| 4,122,559 | 10/1978 | Kelly | 4/558 |
| 4,282,919 | 8/1981 | Teno | 160/269 |
| 4,399,855 | 8/1983 | Volfson | 160/23.1 |
| 4,916,764 | 4/1990 | Meaden et al. | 4/558 |
| 5,333,664 | 8/1994 | Sirianni et al. | 4/558 |
| 5,505,244 | 4/1996 | Thumann | 160/23.1 |

FOREIGN PATENT DOCUMENTS

| | | | |
|---|---|---|---|
| 927016 | 5/1963 | United Kingdom | 160/23.1 |

*Primary Examiner*—Henry J. Recla
*Assistant Examiner*—Charles R. Eloshway

[57] ABSTRACT

A GLASS PROTECTING SHOWER CURTAIN SYSTEM comprising a shower curtain positionable in a shower on a frame of a shower door. The shower curtain is movable to a lower orientation to preclude a shower head spray from contacting the shower door. It is also movable to a raised orientation to allow viewing through the shower door. A container is provided for receiving the shower curtain and for the support thereof. The container has an opening situated adjacent the shower door for allowing the curtain to be positioned adjacent the shower door during use.

2 Claims, 5 Drawing Sheets

38
60
36

52
18
40
24
42
16
36
40
18
34

20
52
22
26
32
20
46
22
48
44
16
18
28
30
50
49
47

GLASS PROTECTING SHOWER CURTAIN SYSTEM

BACKGROUND OF THE INVENTION

This application is a continuation-in-part of a parent application filed May 24, 1996 under Ser. No. 08/653,155, now abandoned.

FIELD OF THE INVENTION

The present invention relates to a new and improved glass protecting shower curtain system and, more particularly, pertains to precluding the undesirable water spotting of a transparent shower door with an easily removed shade assembly which allows the shade thereof to be utilized adjacent an associated shower door.

DESCRIPTION OF THE PRIOR ART

The use of shower curtains of various designs and configurations is known in the prior art. More specifically, shower curtains of various designs and configurations heretofore devised and utilized for the purpose of precluding the undesired water spotting of a transparent shower door through various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of showers of various designs and configurations. By way of example, U.S. Pat. No. 2,481,397 to Dalton, Jr. discloses a shower curtain for bathtubs.

U.S. Pat. No. 3,222,689 to Efron, et al. discloses a vertically slidable shower curtain.

U.S. Pat. No. 3,965,960 to Massey discloses a retractable shower shade with adjustable extensibility.

U.S. Pat. No. 4,122,559 to Kelly discloses shower screens.

U.S. Pat. No. 5,033,132 to Greenblatt discloses a roll-up shower curtain.

U.S. Pat. No. 5,231,708 to Hansen discloses a disposable shower curtain.

Lastly, U.S. Pat. No. 5,333,664 to Sirianni et al. discloses a shower door protection shade with a pair of brackets which are required to encompass a top surface of the frame of the associated shower door. As such, the device of Sirianni is not capable of being utilized with a shower door having a frame embedded within or abutting a ceiling of the shower. Further, the bracket precludes the possibility of a groove being situated adjacent a rear face thereof so that a shade may be positioned adjacent the shower door. This is so since upon the lid of the device of Sirianni et al. being opened, the brackets thereof would abut the shade thereby effecting damage to the shade and further precluding the lid from being entirely opened so that the shade retracting assembly thereof may be replaced or repaired.

In this respect, the glass protecting shower curtain system according to the present invention substantially departs from the conventional concepts and designs of the prior art, and in doing so provides an apparatus primarily developed for the purpose of precluding the undesirable water spotting of a transparent shower door with an easily removed shade assembly which allows the shade thereof to be utilized adjacent an associated shower door.

Therefore, it can be appreciated that there exists a continuing need for a new and improved glass protecting shower curtain system which can be used for precluding the undesirable water spotting of a transparent shower door with an easily removed shade assembly which allows the shade thereof to be utilized adjacent an associated shower door. In addition, it is shown that there is a need for allowing a shower assembly to be retrofitted to a shower door frame which is embedded within or abutting a ceiling of the shower. In this regard, the present invention substantially fulfills this need.

SUMMARY OF THE INVENTION

In view of the foregoing disadvantages inherent in the known types of shower curtains of various designs and configurations now present in the prior art, the present invention provides a new and improved glass protecting shower curtain system. As such, the general purpose of the present invention, which will be described subsequently in greater detail, is to provide a new and improved glass protecting shower curtain system and methods which have all the advantages of the prior art and none of the disadvantages.

To attain this, the present invention essentially comprises a sliding shower door slidably situated within a frame. Further provided are a pair of mounting brackets each having an L-shaped cross-section. Each bracket has a square side face. A rectangular upper face is integrally coupled at a side edge thereof in perpendicular relation with a top edge of the side face. A rectangular rear face is integrally coupled at a side edge thereof in perpendicular relation with a rear edge of the side face. As shown in FIG. 4, the upper face of each mounting bracket has a threaded aperture formed in a central extent thereof. The pair of mounting brackets include a right mounting bracket and a left mounting bracket. The right mounting bracket is equipped with a shade support comprising a tab having an aperture formed therein. Such aperture is formed about an axis which resides in perpendicular relation with the side face. The left mounting bracket includes a shade support comprising a tab with a T-shaped cut out formed therein. See FIG. 4. Also included is an elongate cover with a rectangular front face and a rectangular top face integrally coupled to a top edge of the front face. The top face extends rearwardly from the front face a first predetermined distance. Associated therewith is a rectangular bottom face integrally coupled to a bottom edge of the front face and extending rearwardly therefrom a second predetermined distance which is less than the first predetermined distance. The top face has a pair of apertures formed on opposite ends thereof each a distance from a center thereof equal to ⅜ the total length of the cover. As shown in FIG. 4, a spring loaded shade assembly is provided. Such shade assembly includes a central rod having a first end with a pin extending coaxially therefrom and a rotatable second end with a rectangular member extending coaxially therefrom. The rod has a shade wrapped thereabout which is composed of clear vinyl. The shade has a rectangular strip adhesively coupled along a bottom edge thereof. For reasons that will become apparent later, the strip has a thickness greater than the first predetermined distance minus the second predetermined distance. In operation, the spring loaded shade assembly has a first fixed dispensed orientation upon the manual dispensing thereof which exceeds a predetermined amount and the subsequent release thereof. In addition, the shade has a second retracted orientation upon the manual dispensing thereof which exceeds the predetermined amount and the subsequent release thereof. For maintaining the relative position of the mounting brackets, cover, and shade assembly, a pair of screws are provided for being inserted within the corresponding apertures of the top face of the cover and further screwably engaged with the threaded apertures of the top face of a corresponding mounting bracket. When engaged, the screws maintain the mounting brackets such that the side faces thereof reside coincidentally with respect to a corresponding end edge of the cover. Further, the top faces of the mounting brackets abut a lower surface of the top face of the cover. By this unique design, a slot is defined between the bottom face of the cover and the rear face of the mounting brackets. Also, the rear faces and the top faces of the mounting brackets extend inwardly from the side faces thereof approximately ¼ the length of the cover. It should be noted that the shade assembly is situated between the mounting brackets, wherein the pin of the first end thereof is situated within the aperture of the shade support of the right mounting bracket and the rectangular member of the second end thereof is fixedly coupled within the T-shaped cut out of the shade support of the left mounting bracket. As shown in FIG. 3, the shade is situated within the groove such that the strip thereof resides exterior of the cover and the mounting brackets. Finally, included is a reusable adhesive putty formed of a water resistant formable material. The reusable adhesive putty is applied to an exterior surface of the rear face of both mounting brackets. As such, releasable coupling of the mounting brackets to the frame of the sliding shower door is afforded such that the groove resides adjacent thereto.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved glass protecting shower curtain system which has all the advantages of the prior art showers of various designs and configurations and none of the disadvantages.

It is another object of the present invention to provide a new and improved glass protecting shower curtain system which may be easily and efficiently manufactured and marketed.

It is a further object of the present invention to provide a new and improved glass protecting shower curtain system which is of a durable and reliable construction.

An even further object of the present invention is to provide a new and improved glass protecting shower curtain system which is susceptible of a low cost of manufacture with regard to both materials and labor, and which accordingly is then susceptible of low prices of sale to the consuming public, thereby making such a glass protecting shower curtain system economically available to the buying public.

Even still another object of the present invention is to preclude the undesirable water spotting of a transparent shower door with an easily removed shade assembly which allows the shade thereof to be utilized adjacent an associated shower door.

Still yet another object of the present invention is to afford a unique method of coupling a shower shade assembly to an associated frame of a shower door.

Another object of the present invention is allow the coupling of a shower shade assembly to a shower door frame which is built into or abuts a ceiling.

Lastly, it is an object of the present invention to provide a glass protecting shower curtain system comprising a shower curtain positionable in a shower on a frame of a shower door. The shower curtain is movable to a lower orientation to preclude a shower head spray from contacting the shower door. It is also movable to a raised orientation to allow viewing through the shower door. A container is provided for receiving the shower curtain and for the support thereof. The container has an opening situated adjacent the shower door for allowing the curtain to be positioned adjacent the shower door during use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
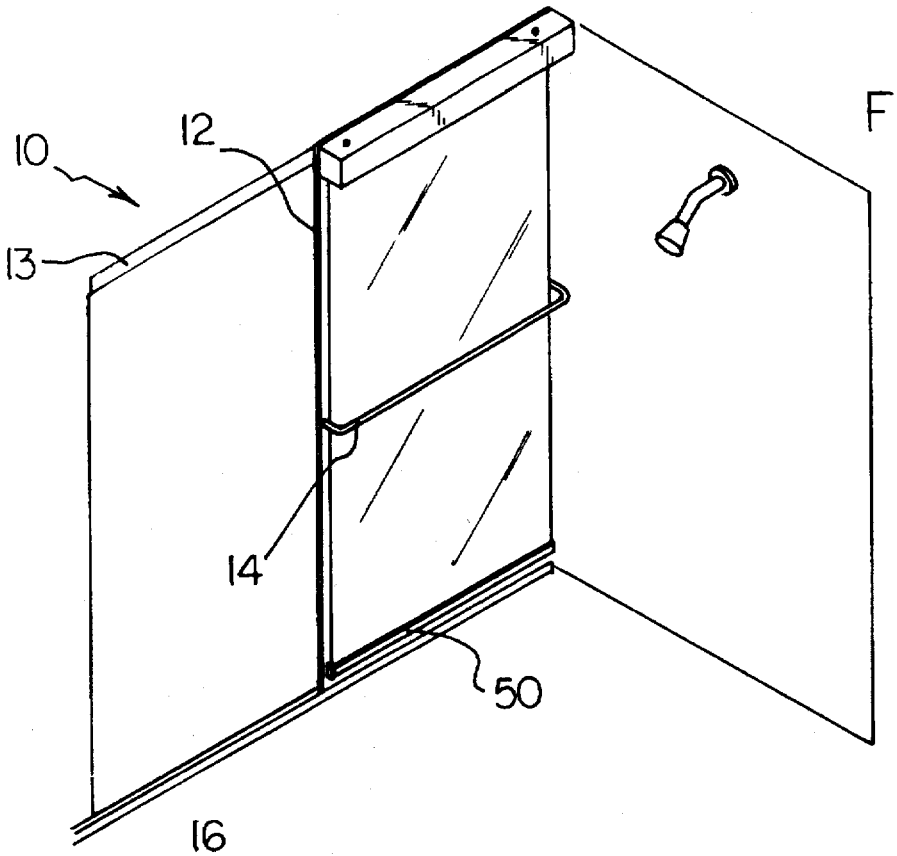
FIG. 1 is a perspective illustration of the preferred embodiment of the new and improved glass protecting shower curtain system constructed in accordance with the principles of the present invention.
Figure 2:
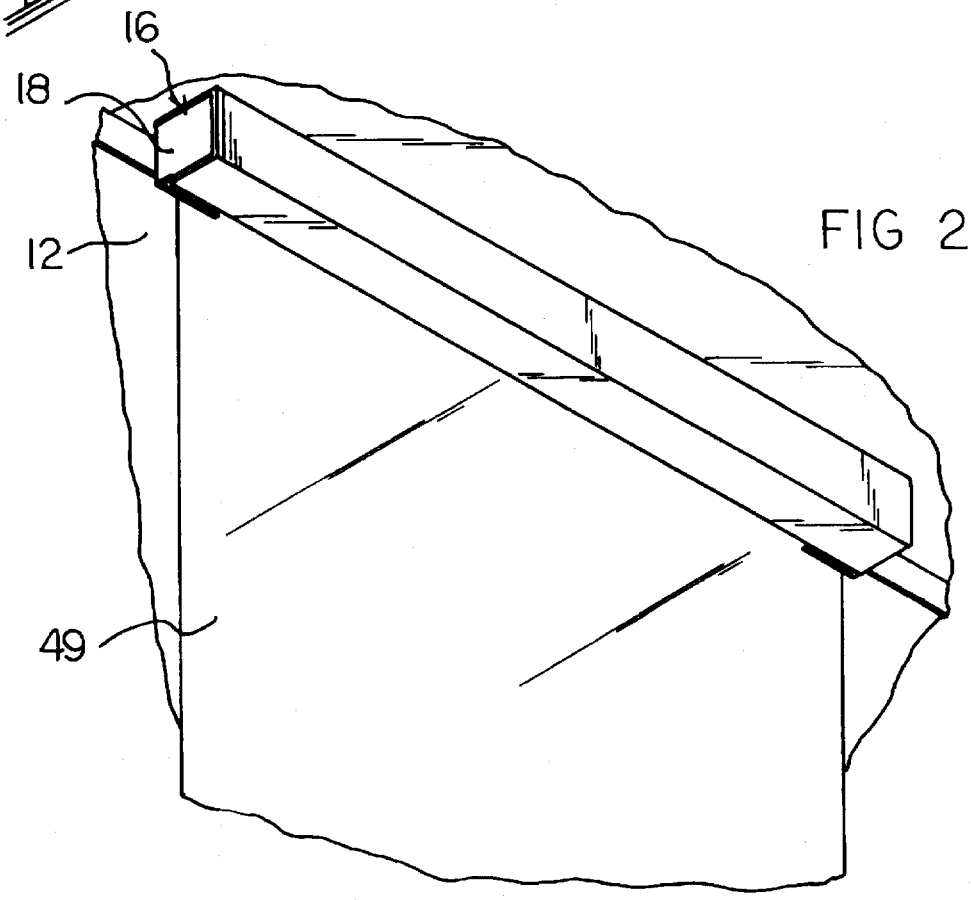
FIG. 2 is a closeup perspective view of the preferred embodiment of the present invention.

With reference now to the drawings, and in particular to FIGS. 1 through 4 thereof, the preferred embodiment of the new and improved glass protecting shower curtain system embodying the principles and concepts of the present invention and generally designated by the reference numeral 10 will be described.

The present invention, the new and improved glass protecting shower curtain system is a system 10 comprised of a plurality of components. Such components, in their broadest context, include a shower door, mounting brackets, cover, shade assembly, and adhesive putty. Each of the individual components is specifically configured and correlated one with respect to the other so as to attain the desired objectives.

Figure 5:
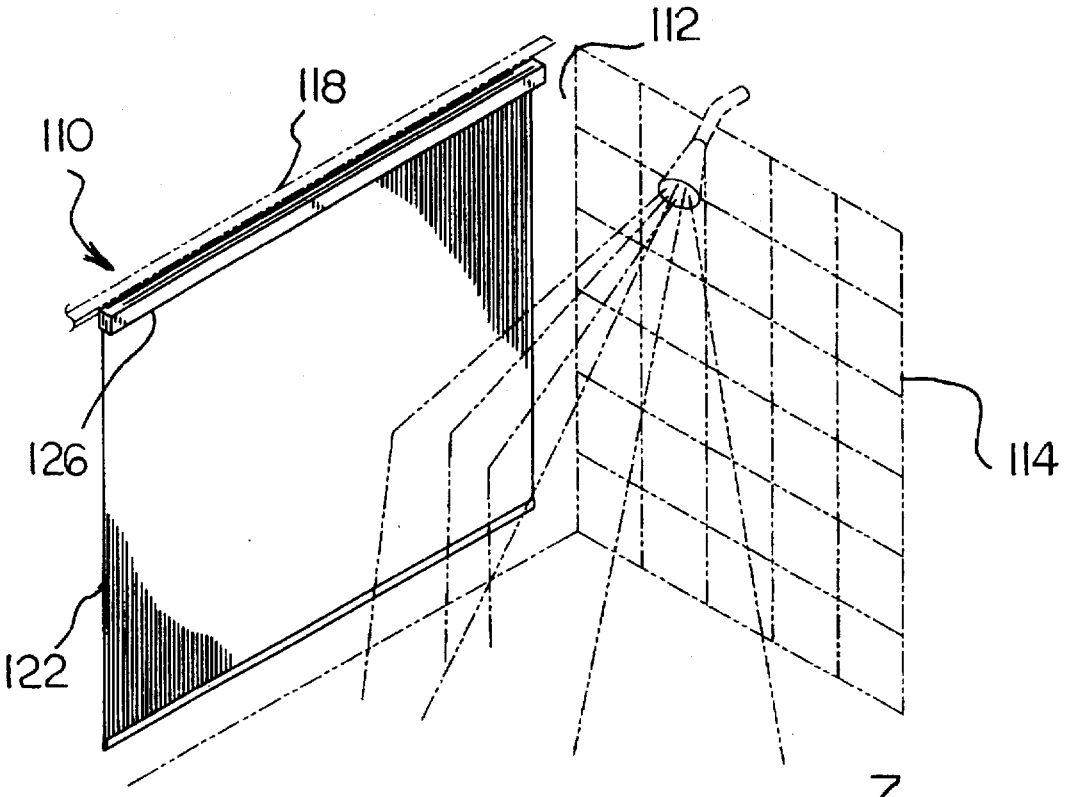
FIG. 5 is a perspective view of an alternate embodiment of the present invention.

Specifically, it will be noted that the system 10 of the present invention includes a sliding shower door 12 slidably situated within a frame 13. While FIG. 1 shows the present invention spanning a single sliding door, it should be noted that the present embodiment may be constructed to span both of the sliding doors as shown in FIG. 5.

Figures 3, 4:
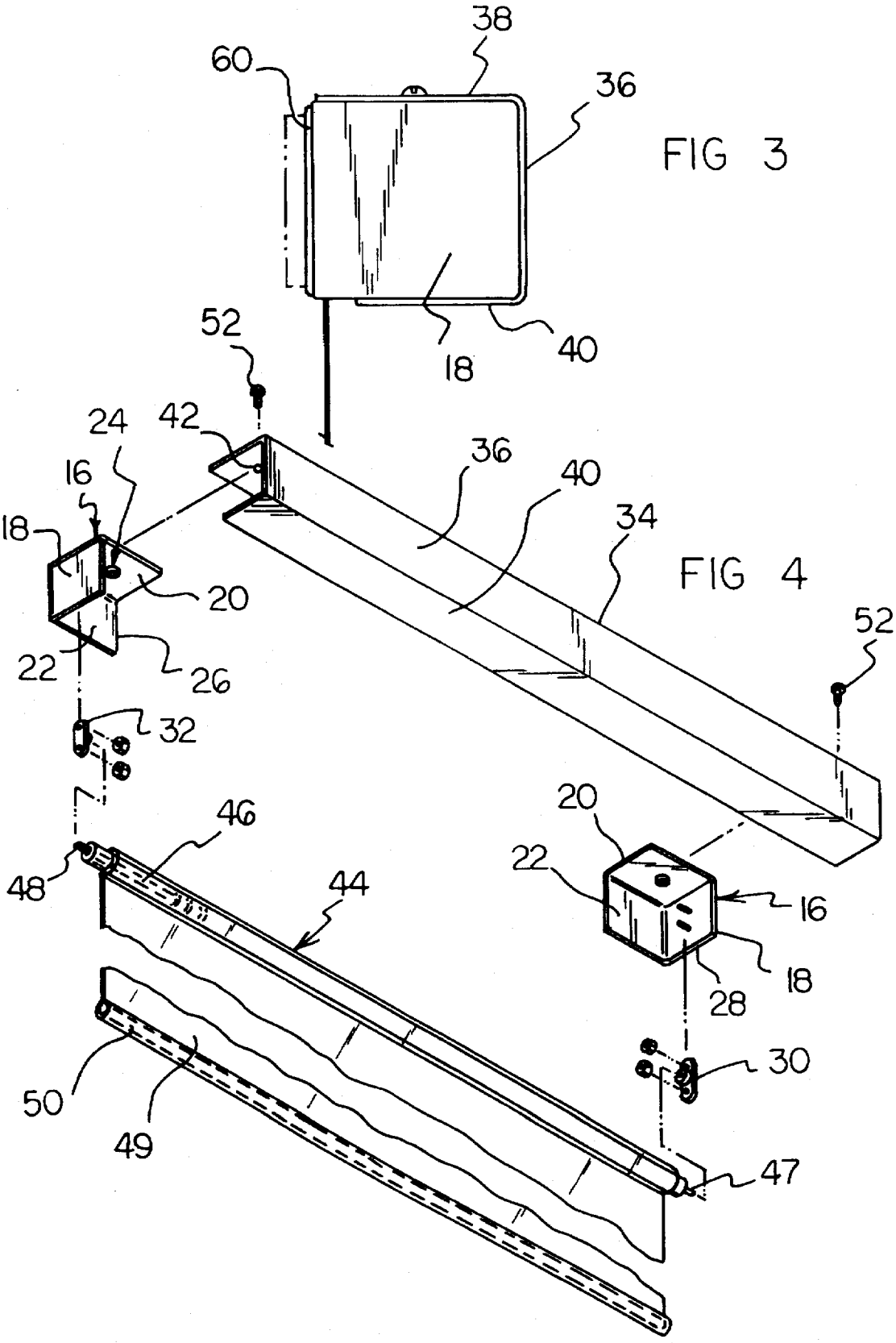
FIG. 3 is a side view of the preferred embodiment of the present invention.
FIG. 4 is an exploded view of the preferred embodiment of the present invention.

Further provided are a pair of mounting brackets 16 each having an L-shaped cross-section. Each bracket has a square side face 18. A rectangular upper face 20 is integrally coupled at a side edge thereof in perpendicular relation with a top edge of the side face. A rectangular rear face 22 is integrally coupled at a side edge thereof in perpendicular relation with a rear edge of the side face. As shown in FIG. 4, the upper face of each mounting bracket has a threaded aperture 24 formed in a central extent thereof. The pair of mounting brackets include a right mounting bracket 28 and a left mounting bracket 26. The right mounting bracket is equipped with a shade support 30 comprising a tab having an aperture formed therein. Such aperture is formed about an axis which resides in perpendicular relation with the side face. The left mounting bracket includes a shade support 32 comprising a tab with a T-shaped cut out formed therein. See FIG. 4.

Also included is an elongate cover 34 with a rectangular front face 36 and a rectangular top face 38 integrally coupled to a top edge of the front face. The top face extends rearwardly from the front face a first predetermined distance. Associated therewith is a rectangular bottom face 40 integrally coupled to a bottom edge of the front face and extending rearwardly therefrom a second predetermined distance which is less than the first predetermined distance. The top face has a pair of apertures 42 formed on opposite ends thereof each a distance from a center thereof equal to ⅜ the total length of the cover.

As shown in FIG. 4, a spring loaded shade assembly 44 is provided. Such shade assembly includes a central rod 46 having a first end with a pin 47 extending coaxially therefrom and a rotatable second end with a rectangular member 48 extending coaxially therefrom. The rod has a shade 49 wrapped thereabout which is composed of clear vinyl. The shade has a rectangular strip 50 adhesively coupled along a bottom edge thereof. For reasons that will become apparent later, the strip has a thickness greater than the first predetermined distance minus the second predetermined distance. In operation, the spring loaded shade assembly has a first fixed dispensed orientation upon the manual dispensing thereof. In addition, the shade has a second retracted orientation.

For maintaining the relative position of the mounting brackets, cover, and shade assembly, a pair of screws 52 are provided for being inserted within the corresponding apertures of the top face of the cover and further screwably engaged with the threaded apertures of the top face of a corresponding mounting bracket. When engaged, the screws maintain the mounting brackets such that the side faces thereof reside coincidentally with respect to a corresponding end edge of the cover. Further, the top faces of the mounting brackets abut a lower surface of the top face of the cover. By this unique design, a slot is defined between the bottom face of the cover and the rear face of the mounting brackets. Also, the rear faces and the top faces of the mounting brackets extend inwardly from the side faces thereof approximately ¼ the length of the cover.

It should be noted that the shade assembly is situated between the mounting brackets, wherein the pin of the first end thereof is situated within the aperture of the shade support of the right mounting bracket and the rectangular member of the second end thereof is fixedly coupled within the T-shaped cut out of the shade support of the left mounting bracket. As shown in FIG. 3, the shade is situated within the groove such that the strip thereof resides exterior of the cover and the mounting brackets. As shown in the Figures, the distance between the shade and the shower door is less than the diameter of the central rod.

Finally, included is a reusable adhesive putty 60 formed of a water resistant formable material. The reusable adhesive putty is applied to an exterior surface of the rear face of both mounting brackets. As such, releasable coupling of the mounting brackets to the frame of the sliding shower door is afforded such that the groove resides adjacent thereto. The unique method of mounting the mounting brackets is specifically tailored to allow the container to be coupled to shower doors that have a top edge which abuts a ceiling of the bathroom. By this structure, applicant's device affords a greater amount of versatility with regard to which sliding shower doors it may be retroffitted to.

When required, the mounting brackets may be removed from the sliding door so that the shade assembly may be replaced whereat the mounting brackets may again be coupled to the frame of the sliding door utilizing the same adhesive putty. As such, by the novel utilization of the adhesive putty, the present invention may be conveniently removed as many times as needed.

Figure 6:
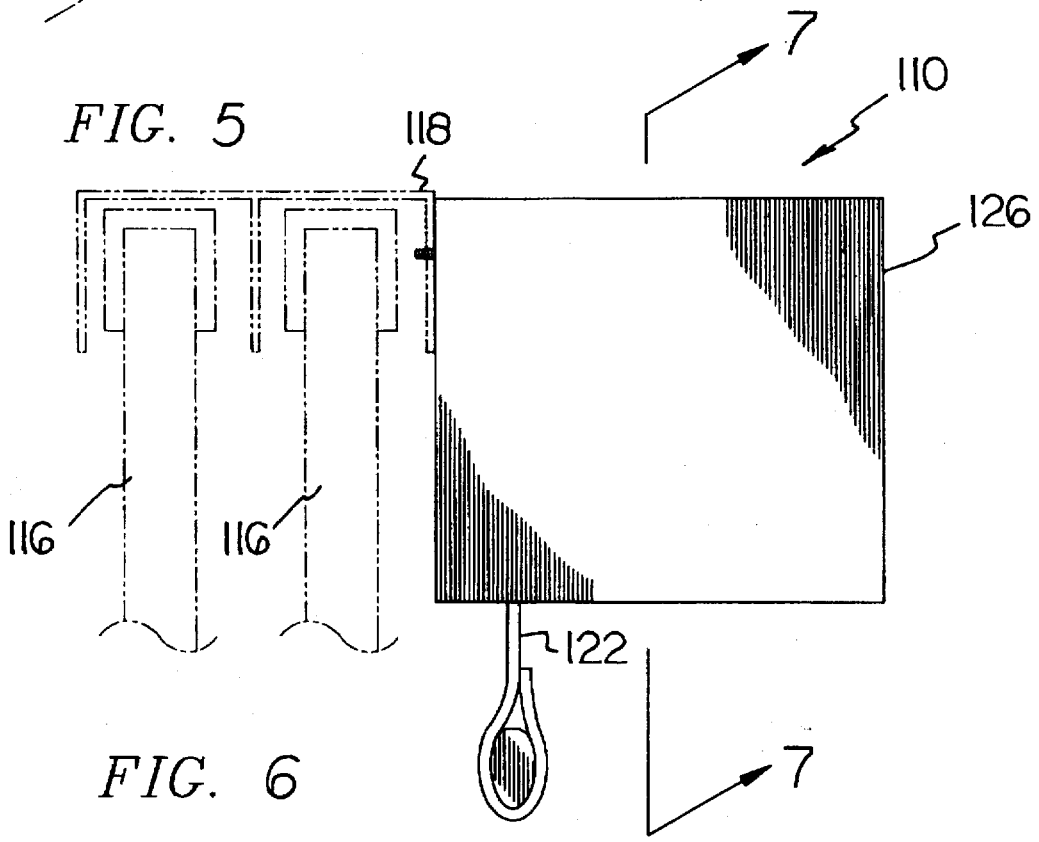
FIG. 6 is a side elevational view of the curtain assembly shown in FIG. 5.
Figure 7:
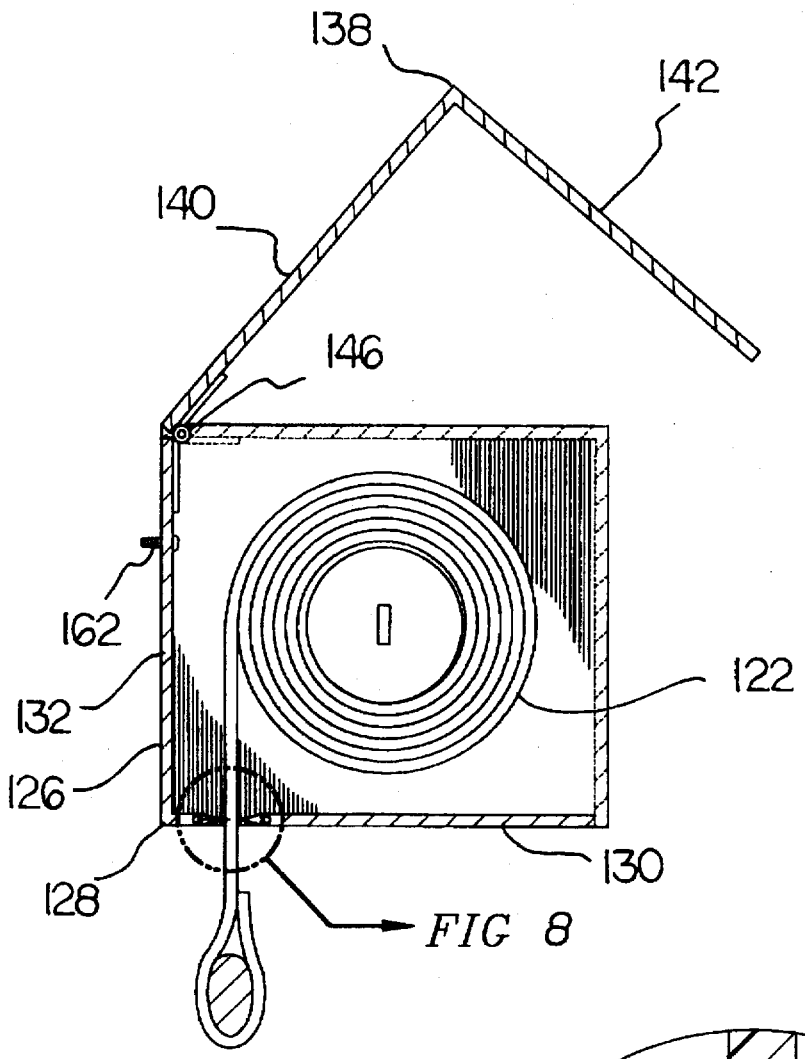
FIG. 7 is a cross-sectional view taken along line 3—3 of FIG. 6.
Figure 8:
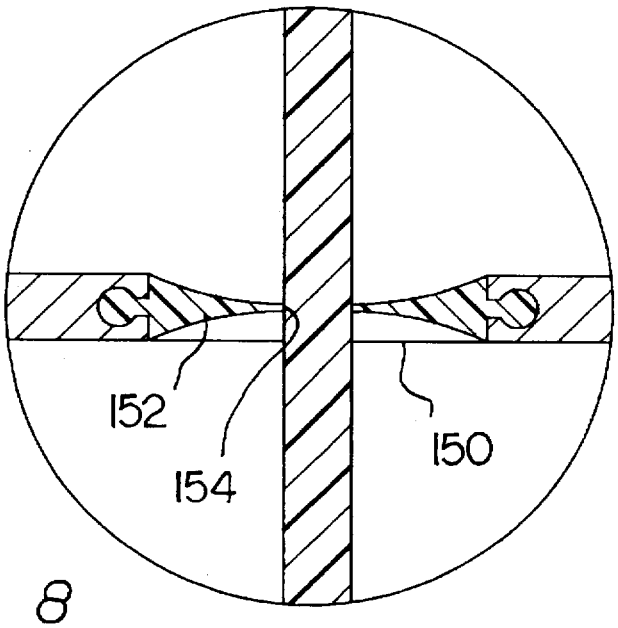
FIG. 8, is an enlarged cross-sectional view of a portion of the container and curtain shown in the prior Figures.
Figure 9:
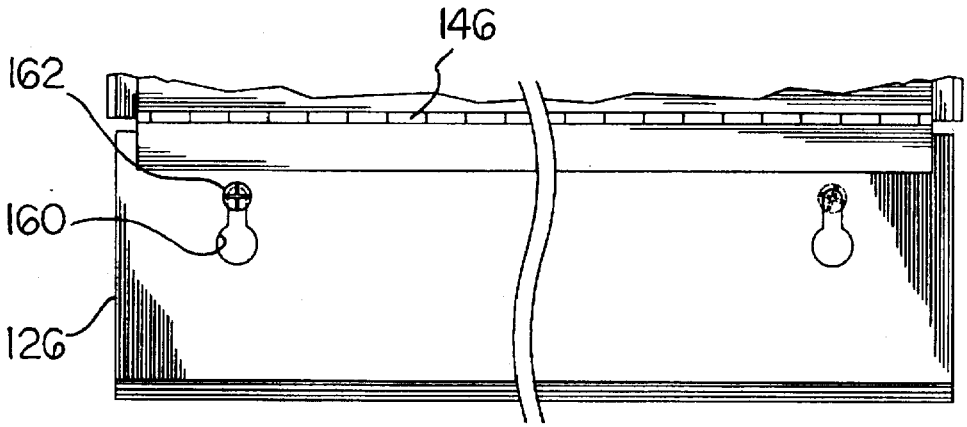
FIG. 9 is a rear elevational view of the container shown in the prior Figures.
Figure 10:
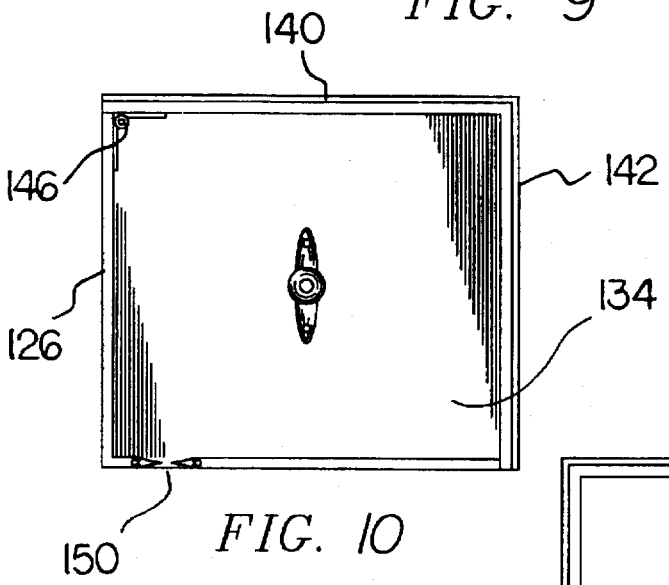
FIG. 10 is a first side elevational view taken from interior of the container.
Figure 11:
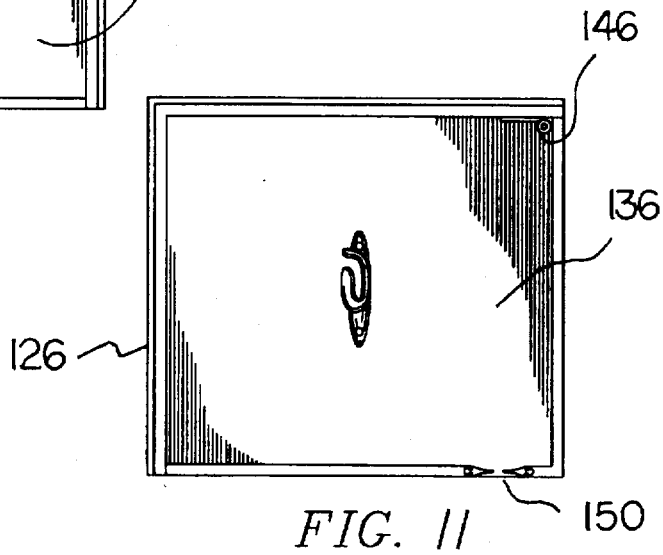
FIG. 11 is a second side elevational view taken from interior of the container.

As shown in FIGS. 5–11, an alternate embodiment is disclosed a conventional shower stall area 112. It has a plurality of vertical walls 114 and a head for spraying water on the user. Such walls are formed in a generally rectangular configuration. Transparent doors 116 close off the shower area during use. Above the door is an upper support area 118. Such area guides the sliding of the door for entrance and egress of the user of the shower. It also constitutes a bracket for supporting the curtain system. The doors are preferably fabricated of a conventional transparent material such as glass or plastic. A shower curtain 122 is positionable adjacent to the upper support area. Such curtain is rotatably movable to a lower orientation as shown in FIG. 5 to shield and preclude water spray emanating from the shower head from contacting the door. The curtain is also movable to a raised orientation as shown in FIG. 6 to allow viewing through the transparent door. The shower curtain is fabricated of a conventional water resistant fabric which is flexible to allow it to be rolled up when not in use. Rolling the curtain up and down is effected in the conventional manner similar to that of window shades.

Next provided as a component of the alternate embodiment is a container 126. Such container is for receiving the shower curtain and for the support thereof. The container has a lower sub-assembly 128 with a base or bottom wall 130, a back wall 132 and ends walls 134 and 136. All such walls are formed to define a configuration to form a generally rectilinear space. Such sub-component also includes an opened front and an opened top. The container also has an upper sub-component 138. Such upper sub-component has a top wall 140 and a front wall 142 with an opened bottom and rear and ends adapted to matingly engage with the bottom sub-component. The upper and lower components together form an enclosed rectilinear configuration with at least a portion of the shower curtain therein. A hinge 146 couples the upper wall of the upper component and the rear wall of the lower component. The hinge functions to allow the pivotal opening and closing of the container to allow access for repair or replacement of the shade.

An opening 150 in the lower wall of the lower sub-component of the container with horizontally disposed resilient fingers 152 forms facing points 154 in contact with the shower curtain including during the raising and lowering of the shower curtain. Apertures 160 in the rear wall of the lower sub-component with screws 162 couples the container to the upper surface area. The present invention is a spring-loaded roller curtain system encased in a metal housing.

The present invention precludes glass-paneled shower or bathtub enclosures from elements such as water, soap scum and dirt. All components of the spring-loaded glass protecting shower curtain system are rustproof. The shower curtain is fabricated of mildew-resistant vinyl or other suitable material. The metal housing can be constructed of anodized aluminum to match the pre-existing framing of the shower or bathtub enclosure. The mounting bracket has keyholes for the screws for installation or can have hanging brackets that fit over the top of the pre-existing railing of the glass panels. The back may have a flat strip of rubber along the entire width of the back bottom edge. The lid bottom may have a rubber strip along the entire width on the bottom edge. The end caps are coupled with respect to the ends of the lid. The depth and height of the lid, back and end caps remain the same always.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved GLASS PROTECTING SHOWER CURTAIN SYSTEM for precluding a shower head spray from contacting an adjacent shower door, comprising in combination:

a sliding shower door slidably situated within a frame;

a pair of mounting brackets each having an L-shaped cross-section with a square side face, a rectangular upper face integrally coupled at a side edge thereof in perpendicular relation with a top edge of the side face, and a rectangular rear face integrally coupled at a side edge thereof in perpendicular relation with a rear edge of the side face, the upper face of each mounting bracket having a threaded aperture formed in a central extent thereof, the pair of mounting brackets including a right mounting bracket with a shade support comprising a tab with an aperture formed therein with the aperture formed about an axis which resides in perpendicular relation with the side face, the pair of mounting brackets further including a left mounting bracket with a shade support comprising a tab with a T-shaped cut out formed therein;

an elongate cover including a rectangular front face, a rectangular top face integrally coupled to a top edge of the front face and extending rearwardly therefrom a first predetermined distance, and a rectangular bottom face integrally coupled to a bottom edge of the front face and extending rearwardly therefrom a second predetermined distance which is less than the first predetermined distance, the top face having a pair of apertures formed on opposite ends thereof each a distance from a center thereof equal to ⅜ the total length of the cover;

a spring loaded shade assembly including a central rod having a first end with a pin extending coaxially therefrom and a rotatable second end with a rectangular member extending coaxially therefrom, the rod having a shade composed of clear vinyl wrapped thereabout, the shade having a rectangular strip adhesively coupled along a bottom edge thereof with the strip having a thickness greater than the first predetermined distance minus the second predetermined distance, whereby the spring loaded shade assembly has a first fixed dispensed orientation upon the manual dispensing thereof and further a second retracted orientation;

a pair of screws for being inserted within the corresponding apertures of the top face of the cover and further screwably engaged with the threaded apertures of the top face of a corresponding mounting bracket such that the side faces of the mounting brackets reside coincidentally with respect to a corresponding end edge of the cover and further the top faces of the mounting brackets abut a lower surface of the top face of the cover, wherein a slot is defined between the bottom face of the cover and the rear face of the mounting brackets and the rear faces and the top faces of the mounting brackets extend inwardly from the side faces thereof approximately ¼ the length of the cover;

said shade assembly situated between the mounting brackets wherein the pin of the first end thereof is situated within the aperture of the shade support of the right mounting bracket, the rectangular member of the second end thereof is fixedly coupled within the T-shaped cut out of the shade support of the left mounting bracket, and the shade is situated within the slot such that the strip thereof resides exteriorly of the cover and the mounting brackets; and reusable adhesive putty formed of a water resistant formable material, the reusable adhesive putty applied to an exterior surface of the rear face of both mounting brackets for allowing the releasable coupling thereof to the frame of the sliding shower door such that the slot resides adjacent thereto;

whereby the mounting brackets may be removed from the frame so that the shade assembly may be replaced whereat the mounting brackets may again be coupled to the frame of the sliding door utilizing the same adhesive putty.

2. A new and improved GLASS PROTECTING SHOWER CURTAIN SYSTEM for precluding a shower head spray from contacting an adjacent shower door, comprising in combination:

a pair of mounting brackets each having an L-shaped cross-section with a square side face, a rectangular upper face integrally coupled at a side edge thereof in perpendicular relation with a top edge of the side face, and a rectangular rear face integrally coupled at a side edge thereof in perpendicular relation with a rear edge of the side face, the upper face of each mounting bracket having a threaded aperture formed in a central extent thereof, the pair of mounting brackets including a right mounting bracket and a left mounting bracket;

an elongate cover including a rectangular front face, a rectangular top face integrally coupled to a top edge of the front face and extending rearwardly therefrom a first predetermined distance, and a rectangular bottom face integrally coupled to a bottom edge of the front face and extending rearwardly therefrom a second predetermined distance which is less than the first predetermined distance, the top face having a pair of apertures formed on opposite ends thereof;

a spring loaded shade assembly including a central rod having a shade composed of clear vinyl wrapped thereabout, the shade having a rectangular strip coupled along a bottom edge thereof with the strip having a thickness greater than the first predetermined distance minus the second predetermined distance, whereby the spring loaded shade assembly has a fixed dispensed orientation and further a retracted orientation;

a pair of screws for being inserted within the corresponding apertures of the top face of the cover and further screwably engaged with the threaded apertures of the top face of a corresponding mounting bracket such that the side faces of the mounting brackets reside coincidentally with respect to a corresponding end edge of the cover and further the top faces of the mounting brackets abut a lower surface of the top face of the cover, wherein a slot is defined between the bottom face of the cover and the rear face of the mounting brackets;

said shade assembly situated between the mounting brackets and the shade is situated within the slot such that the strip thereof resides exteriorly of the cover and the mounting brackets; and coupling means for coupling the mounting brackets to the frame of the sliding shower door such that the slot resides adjacent thereto, said coupling means comprising reusable adhesive putty formed of a water resistant formable material, the reusable adhesive putty being applied to an exterior surface of the rear face of both mounting brackets for allowing the releasable coupling thereof to the frame of the sliding shower door, whereby the mounting brackets may be removed from the frame so that the shade assembly may be replaced whereat the mounting brackets may again be coupled to the frame of the sliding shower door utilizing the same adhesive putty.

* * * * *